US009263818B2

(12) United States Patent
Lam et al.

(10) Patent No.: US 9,263,818 B2
(45) Date of Patent: Feb. 16, 2016

(54) METHODS AND APPARATUS RELATED TO RECEPTACLES AND RELEASABLE CONNECTORS

(71) Applicant: Google Inc., Mountain View, CA (US)

(72) Inventors: Lawrence Lam, San Jose, CA (US); Aaron Leiba, San Francisco, CA (US)

(73) Assignee: Google Inc., Mountain View, CA (US)

( * ) Notice: Subject to any disclaimer, the term of this patent is extended or adjusted under 35 U.S.C. 154(b) by 303 days.

(21) Appl. No.: 13/734,622

(22) Filed: Jan. 4, 2013

(65) Prior Publication Data

US 2014/0193997 A1 Jul. 10, 2014

(51) Int. Cl.

| | |
|---|---|
| ***H01R 13/58*** | (2006.01) |
| ***H01R 13/40*** | (2006.01) |
| ***H01R 43/20*** | (2006.01) |
| ***H01R 13/631*** | (2006.01) |
| ***H01R 24/60*** | (2011.01) |

(52) U.S. Cl.
CPC ..... *H01R 13/40* (2013.01); *H01R 13/631* (2013.01); *H01R 24/60* (2013.01); *H01R 43/20* (2013.01); *Y10T 29/49204* (2015.01)

(58) Field of Classification Search
CPC ..... H01R 13/40; H01R 24/60; H01R 43/20
USPC ..... 439/474, 660
See application file for complete search history.

(56) References Cited

U.S. PATENT DOCUMENTS

| | | | | |
|---|---|---|---|---|
| 3,264,601 | A * | 8/1966 | Hartholz | 439/701 |
| 4,077,690 | A | 3/1978 | Koether | |
| 5,941,729 | A | 8/1999 | Sri-Jayantha | |
| 6,264,500 | B1 * | 7/2001 | Kawabe | 439/496 |
| 6,431,887 | B1 | 8/2002 | Yeomans et al. | |
| 6,461,192 | B1 | 10/2002 | Kwoka | |
| 2006/0024997 | A1 | 2/2006 | Teicher | |
| 2006/0065681 | A1 | 3/2006 | Yeh et al. | |
| 2009/0181572 | A1 * | 7/2009 | Tracy et al. | 439/447 |
| 2012/0015561 | A1 | 1/2012 | Tsai | |

FOREIGN PATENT DOCUMENTS

| | | | |
|---|---|---|---|
| EP | 1670101 | A1 | 6/2006 |
| EP | 1933259 | A1 | 6/2008 |
| WO | 2011/150403 | A1 | 12/2011 |

OTHER PUBLICATIONS

International Search Report and Written Opinion for International Application No. PCT/US2014/010050, mailed Mar. 28, 2014, 15 pages.

* cited by examiner

*Primary Examiner* — Khiem Nguyen

(74) *Attorney, Agent, or Firm* — Brake Hughes Bellermann LLP

(57) ABSTRACT

An apparatus can include a support portion of a connector and at least a portion of wire component coupled to a first side of the support portion. The apparatus can include a protrusion portion have a distal portion, a proximal portion, and an opening disposed between the distal portion and the proximal portion. The proximal portion can be coupled to a second side of the support portion, and the protrusion portion can have a width tapering from the proximal portion to the distal portion. A contact can be disposed in the protrusion portion and can have a surface exposed to an ambient environment through the opening.

20 Claims, 19 Drawing Sheets

METHODS AND APPARATUS RELATED TO RECEPTACLES AND RELEASABLE CONNECTORS

TECHNICAL FIELD

This description relates to receptacles and releasable connectors.

BACKGROUND

Many known computing devices can have one or more receptacles to which one or more connectors can be coupled (e.g., inserted). Receptacles and connectors can function as conduits through which signals, power, etc. can be communicated to and/or from outside sources (e.g., external peripherals) to the computing devices. As a specific example, a computing device can be supplied with power through a connector of an electrical cord of a power adapter that can be inserted into a receptacle included within a housing of the computing device.

Because connectors of an electrical cord are often coupled to an external source, the connectors and/or electrical cords including the connectors can be exposed to unintentionally applied external forces. For example, a connector inserted into a receptacle within a housing of a computing device can extend from the housing of the computing device. The connector, because it extends from the housing of the computing device, can be unintentionally hit and/or pulled by a user of the computing device and/or object that can cause damage to the connector and/or the receptacle into which the connector is inserted. Thus, a need exists for systems, methods, and apparatus to address the shortfalls of present technology and to provide other new and innovative features.

SUMMARY

In one general aspect, an apparatus can include a support portion of a connector and at least a portion of wire component coupled to a first side of the support portion. The apparatus can include a protrusion portion having a distal portion, a proximal portion, and an opening disposed between the distal portion and the proximal portion. The proximal portion can be coupled to a second side of the support portion, and the protrusion portion can have a width tapering from the proximal portion to the distal portion. A contact can be disposed in the protrusion portion and can have a surface exposed to an ambient environment through the opening.

In another general aspect, an apparatus can include a support portion and at least a portion of a wire component coupled to a first side of the support portion. The apparatus can include a protrusion portion extending from a second side of the support portion and aligned along a longitudinal axis intersecting the support portion where the protrusion portion has a length along the longitudinal axis greater than a width between a first side and a second side of the protrusion portion. The first side of the protrusion portion can be aligned along a line non-parallel to the longitudinal axis, and the protrusion portion can have an opening. A contact can be disposed in the protrusion portion and can have a surface exposed to an ambient environment through the opening.

In yet another general aspect, a method can include receiving a protrusion contact made of a conductive material, and forming a protrusion portion of a connector of an electrical cord around the protrusion contact. The protrusion portion can have a distal portion, a proximal portion, and an opening through which at least a portion of the protrusion contact is exposed. The protrusion portion can have a width tapering from the proximal portion to the distal portion.

The details of one or more implementations are set forth in the accompanying drawings and the description below. Other features will be apparent from the description and drawings, and from the claims.

DETAILED DESCRIPTION

Figure 1A:
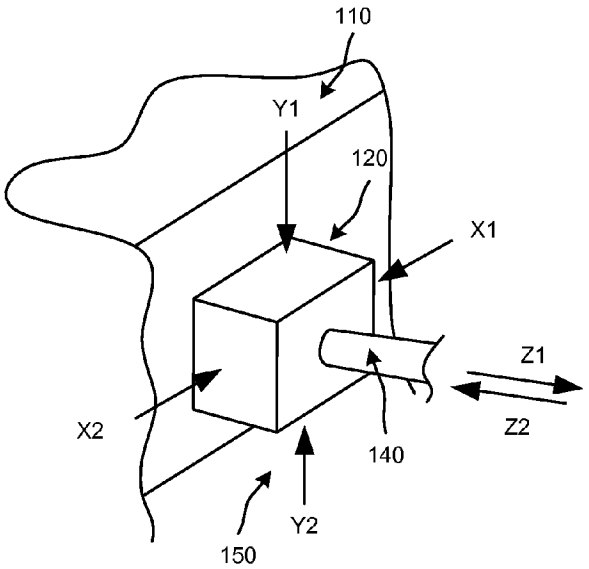
FIGS. 1A through 1E illustrate various views of a connector.

FIGS. 1A through 1E illustrate various views of a connector 120. In some embodiments, the connector 120 can be referred to as a plug. Specifically, FIG. 1A is a diagram that illustrates a perspective view of the connector 120 coupled to a wire component 140 and inserted into a receptacle 160 (not shown in FIG. 1A) included in a housing 110 of a computing device. The connector 120 and the wire component 140 are included in an electrical cord 150 (also can be referred to as a cable). In other words, the electrical cord 150 includes the wire component 140 coupled to the connector 120. In some implementations, the connector 120 can be referred to as a releasable connector. In some implementations, the connector 120 can be referred to as a connector portion of the electrical cord 150, and the wire component 140 can be referred to as a wire portion of the electrical cord 150. In this embodiment, the distinction between the receptacle 160 and the housing 110 is not shown in this embodiment.

The connector 120 and the receptacle 160 are configured so that the connector 120 can be released in a desirable fashion (e.g., can be readily or easily released) from (e.g., decoupled from) the receptacle 160 in response to a force applied to the connector 120 (or another portion of the electrical cord 150) in a horizontal direction (also can be referred to as a horizontal force), a force applied to the connector 120 (or another portion of the electrical cord 150) in a vertical direction (also can be referred to as a vertical force), or a force applied to the connector 120 (or another portion of the electrical cord 150) in a combination of a horizontal direction and vertical direction. Horizontal directions are represented within FIG. 1A by vector X1 and vector X2, and vertical directions are represented by vector Y1 and vector Y2. Combinations of horizontal and vertical directions (which can be referred to as diagonal directions) are not shown in FIG. 1A. The horizontal direction and vertical direction are contrasted with a pushing direction (represented by a vector Z2) and a pulling direction (represented by a vector Z1). At least a portion of the connector 120 can be inserted into the receptacle 160 by moving the connector 120 along direction Z2. The connector 120 can also be released from (e.g., decoupled from) the receptacle 160 when pulled along direction Z1.

In some implementations, the horizontal direction and/or the vertical direction can include some component of a pushing direction or a pulling direction. Accordingly, the horizontal direction can primarily be a horizontal direction (with some components of pushing, pulling, and/or vertical directions) and the vertical direction can primarily be a vertical direction (with some components of pushing, pulling, and/or horizontal directions). In some implementations, the connector 120 and/or the receptacle 160 can be configured so that the connector 120 can be released from the receptacle 160 in response to a force applied in any combination of a horizontal direction and/or a vertical direction and direction Z1.

In some implementations, the horizontal direction, the vertical direction, and/or the pushing/pulling direction can be oriented with respect to a front surface 163 (shown in FIG. 1B) around or of the receptacle 160. For example, the horizontal direction and the vertical direction can be disposed within a plane parallel to the front surface 163 around or of the receptacle 160. In some implementations, the horizontal direction and the vertical direction can be orthogonal to the pushing direction (which is a direction that the connector 120 is inserted into the receptacle 160) and/or the pulling direction (which can be a direction that the connector 120 can be pulled out the receptacle 160).

In some implementations, the electrical cord 150 can function as a mechanism through which one or more signals, power, etc. can be communicated to and/or from external peripherals to the computing device. For example, the electrical cord 150 can be associated with the power adapter (e.g., alternating current (AC) power adapter, a direct current (DC) adapter) that can be plugged into the computing device. In some implementations, the electrical cord 150 can be associated with a music and/or video player and can be used to transmit audio and/or video signals to and/or from the computing device. In some implementations, the electrical cord 150 can be associated with one or more communication protocols.

Figure 1C:
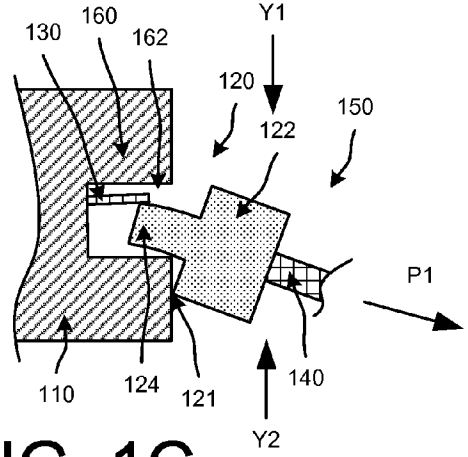
Figure 1B:
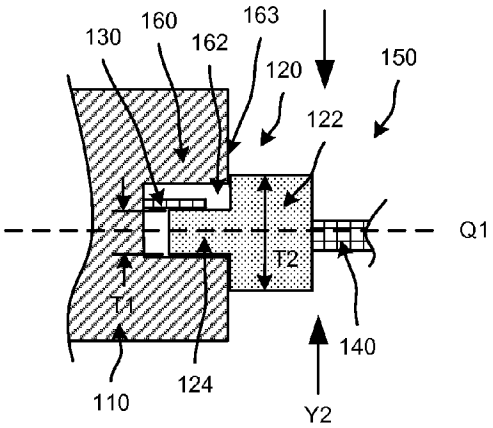

FIG. 1B is a cross-sectional view of the components shown in FIG. 1A cut along a vertically oriented plane (e.g., a vertically oriented plane aligned along direction Y1). As shown in FIG. 1B, the connector 120 has a support portion 122 and a protrusion portion 124. The protrusion portion 124 is configured to be inserted into (e.g., and disposed within) a cavity 162 of a receptacle 160. The receptacle 160 is included in (e.g., disposed within) a housing 110 of a computing device. In some implementations, the receptacle 160 can be made of a separate component that is inserted into the housing 110 or that can be integrated into a structure of the housing 110. As shown in FIG. 1B, at least a portion of the protrusion portion 124 is configured to physically contact (e.g., come in contact with) a receptacle contact 130.

As shown in FIG. 1B, the protrusion portion 124 extends from the support portion 122. In this implementation, the protrusion portion 124 extends from a side of the support portion 122 that is opposite a side of the support portion 122 from which the wire component 140 extends. Also, in this implementation, the protrusion portion 124 is aligned along a plane Q1 (or longitudinal axis) that intersects the support portion 122. In some implementations, the protrusion portion 124 can extend from a side of the support portion 122 that is not opposite (e.g., is adjacent to or coupled to) a side of the support portion 122 from which the wire component 140 extends.

As shown in FIG. 1B, the protrusion portion 124 has a thickness T1 that is less than a thickness T2 of the support portion 122 of the connector 120. In some implementations, the thickness T1 can be greater than or equal to the thickness T2 of the support portion 122. In some implementations, the thickness T1 of the protrusion portion 124 can taper (e.g., taper with decreasing thickness away from the support portion 122 or taper with decreasing thickness toward the support portion 122). Although not shown, in some implementations, the thickness T2 of the support portion 122 can taper.

FIG. 1C is a cross-sectional view of the components shown in FIG. 1B when a force is applied along direction Y1 to the connector 120 (and/or the wire component 140). As shown in FIG. 1C, the connector 120 has an edge 121 (or point) around which the connector 120 pivots when a force is applied along direction Y1. As the connector 120 pivots about the edge 121, the connector 120 and the wire component 140 are moved along direction P1 until the connector 120 is moved out of (e.g., entirely out of) the receptacle 160. In some implementations, the edge 121 can function as a fulcrum (e.g., a fulcrum for release in a vertical direction, a pivot point). In some implementations, the connector 120 can be referred to as rotating about an axis when the force applied along direction Y1. The axis can be a horizontal axis (out of the page) that is disposed within the plane Q1 along which the protrusion portion 124 is aligned. In some implementations, the horizontal axis can be at, or approximately at, the edge 121. Although not shown, the connector 120 can similarly be decoupled from the receptacle 160 in response to a force applied along direction Y2.

As shown in FIG. 1C, the protrusion portion 124 is configured to bend (or flex) in response to the force being applied along direction Y1. In this implementation, the bending of the protrusion portion 124 facilitates (e.g., permits) removal of the connector 120 from the receptacle 160. Also, in this implementation, the receptacle contact 130 is configured to bend (or flex) in response to the force of the protrusion portion 124 applied to the receptacle contact 130 as the connector 120 rotates when the force is applied along direction Y1. In this implementation, the bending of the receptacle contact 130 facilitates (e.g., permits) removal of the connector 120 from the receptacle 160. In some implementations, the receptacle contact 130 can be configured so that the receptacle contact 130 does not bend (e.g., is rigid, has a fixed position) as the connector 120 is rotatably moved out of the receptacle 160.

Figure 1E:
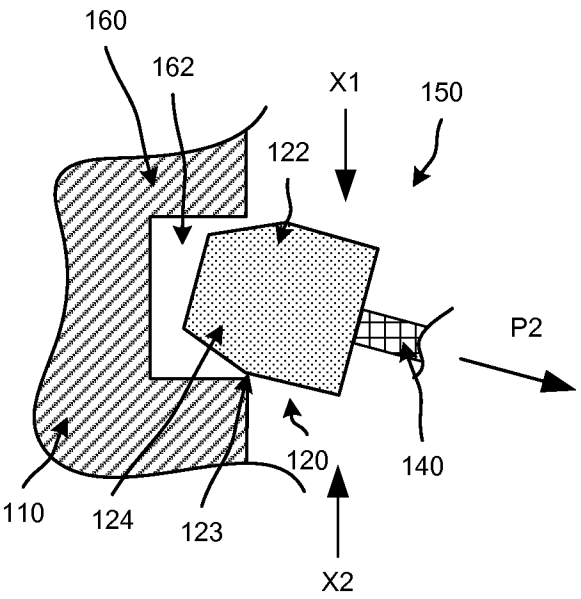
Figure 1D:
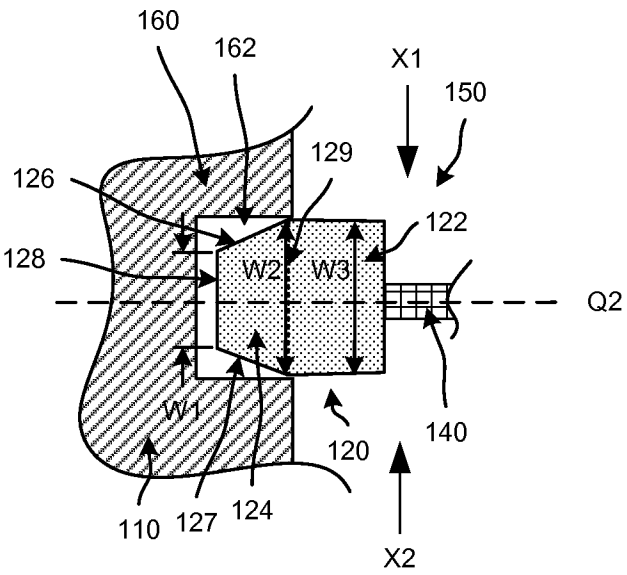

FIG. 1D is a cross-sectional view of the components shown in FIG. 1A cut along a horizontally oriented plane (e.g., a horizontally oriented plane aligned along direction X1). As shown in FIG. 1D, the protrusion portion 124 is disposed in the cavity 162 of the receptacle 160. In this implementation, the receptacle contact 130 may not be shown because the receptacle contact 130 can be disposed above this cross-sectional view.

As shown in FIG. 1D, the protrusion portion 124 has a trapezoidal shape (or profile) that extends from the support portion 122. The trapezoidal shape has a proximal portion 129 (e.g., a base portion) (illustrated by a dashed line in this implementation) that is coupled to the support portion 122. In this implementation, the trapezoidal shape of the protrusion portion 124 has a substantially flat surface at a distal end of the distal portion 128 that is aligned parallel to a proximal end of the proximal portion 129. Accordingly, in this implementation, the protrusion portion 124 has a shape that tapers from the proximal portion 129 to the distal portion 128. In some implementations, the trapezoidal shape may not have a substantially flat top surface of the distal portion 128 and/or may be non-parallel to the proximal portion 129.

In this implementation, the trapezoidal shape of the protrusion portion 124 has a sidewall 127 nonparallel to a sidewall 126. In this implementation, the trapezoidal shape of the protrusion portion 124 is symmetric about a longitudinal axis Q2 . In some implementations, the sidewalls 126, 127 can be configured so that the trapezoidal shape of the protrusion portion 124 is asymmetrical about a longitudinal axis Q2. As shown in FIG. 1D, the sidewall 126 and the sidewall 127 are aligned along lines that are non-parallel to the longitudinal axis Q2. In some implementations, one or more of the sidewalls 126, 127 can have a curved portion. In some implementations, one or more of the sidewalls 126, 127 can be referred to as a chamfered portion of the connector 120. In some implementations, one or more of the sidewalls 126, 127 can have a radius. Although not shown, in some implementations, a contact can be coupled to one or more of the sidewalls 126, 127, and corresponding receptacle contacts can be included in the receptacle 160.

Because the protrusion portion 124 tapers from the proximal portion 129 to the distal portion 128, the proximal portion 129 can have a width W2 that is greater than a width W1 of the distal portion 128. In some implementations, the width W2 of the proximal portion 129 of the protrusion portion 124 can be approximately equal to a width W3 of the support portion 122 of the connector 120. In some implementations, the width W2 of the proximal portion 129 can be greater than or less than the width W3 of the support portion 122. In some implementations, the width W3 of the support portion 122 can be equal to or different than (e.g., less than, greater than) the thickness T2 of the support portion 122 (shown in FIG. 1B). In some implementations, the width W2 and/or the width W3 can be greater than or equal to the thickness T1 of the protrusion portion 124 (shown in FIG. 1B).

FIG. 1E is a cross-sectional view of the components shown in FIG. 1D when a force is applied along direction X1 to the connector 120 (and/or the wire component 140). As shown in FIG. 1C, the connector 120 has an edge 123 (or point) around which the connector 120 pivots when a force is applied along direction X1. As the connector 120 pivots about the edge 123, the connector 120 and the wire component 140 are moved along direction P2 until the connector 120 is moved out of (e.g., entirely out of) the receptacle 160. In some implementations, the edge 123 can function as a fulcrum (e.g., a fulcrum for release in a horizontal direction). In some implementations, the connector 120 can be referred to as rotating about an axis when the force applied along direction X1. The axis can be a vertical axis (out of the page) that is orthogonal to the plane Q1 and/or the longitudinal axis Q2. In some implementations, the vertical axis can be at, or approximately at, the edge 123. Although not shown, the connector 120 can similarly be decoupled from the receptacle 160 in response to a force applied along direction X2.

Although not shown in FIGS. 1A through 1E, a connector can be configured with a trapezoidal shape, such as that shown in FIGS. 1D and 1E on more than two sides of the connector (e.g., all 4 sides). Although not shown in FIGS. 1A through 1E, a connector can be configured to be flexible in a variety of directions. For example, a connector can be configured to be flexible in an X direction and in a Y direction.

In some implementations, one or more signals can be communicated through the electrical cord 150 to the receptacle 160. For example, electrical cord 150 can be configured to transmit a one or more signals associated with a standard communication protocol and/or a proprietary communication protocol.

In some implementations, the receptacle contact 130 can be made of one or more conductive materials such as copper, gold, aluminum, and/or so forth. In some implementations, the connector 120 can be made of one or more vinyl-based products. In some implementations, the connector 120 can be made of an over-molded elastomer, a thermoplastic elastomer, thermoplastic polyurethane, and/or so forth. In some implementations, the wire component 140 can include a sheath, one or more wires, and/or so forth.

In some implementations, the housing 110 can be associated with a computing device such as a personal computing laptop-type device. In some implementations, the housing 110 can be associated with any type of computing device. The computing device can be, for example, a wired device and/or a wireless device (e.g., wi-fi enabled device) and can be, for example, a computing entity (e.g., a personal computing device), a server device (e.g., a web server), a television including one or more processors, a tablet device, a mobile phone, a personal digital assistant (PDA), an e-book device, and/or so forth. The computing device can be configured to operate based on one or more platforms (e.g., one or more similar or different platforms) that can include one or more types of hardware, software, firmware, operating systems, runtime libraries, and/or so forth. More details related to various configurations of a computing device that has a display portion configured to move with respect to a base portion are described in connection with the figures below.

Figure 2A:
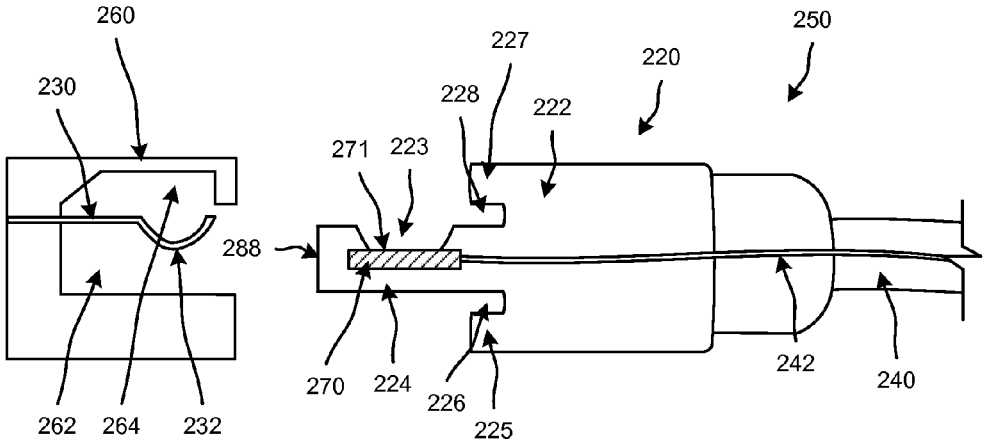
FIGS. 2A through 2D illustrate side cross-sectional views of a connector and a receptacle.

FIGS. 2A through 2D illustrate side cross-sectional views of a connector 220 and a receptacle 260. As shown in FIG. 2A, the connector 220 has a support portion 222 and a protrusion portion 224. The protrusion portion 224 is configured to be inserted into (e.g., and disposed within) a cavity 262 of a receptacle 260. Although not shown, the receptacle 260 can be included in (e.g., disposed within) a housing of a computing device. In FIG. 2A, the connector 220 is disposed outside of the cavity 262 of the receptacle 260. In some embodiments, at least some portions that are identified as the receptacle 260 shown in this embodiment can be a portion of a housing of a computing device. For example, a portion of the receptacle 260 defining the cavity 262 can be a portion of a housing.

The connector 220 and the wire component 240 are included in an electrical cord 250. In other words, the electrical cord 250 includes the wire component 240 coupled to the connector 220. In some implementations, the connector 220 can be referred to as a releasable connector. In some implementations, the connector 220 can be referred to as a connector portion of the electrical cord 250, and the wire component 240 can be referred to as a wire portion of the electrical cord 250.

The connector 220 and the receptacle 260 are configured so that the connector 220 can be readily released from (e.g., decoupled from) the receptacle 260 in response to a force applied to the connector 220 (or another portion of the electrical cord 250) in a horizontal direction, a force applied to the connector 220 (or another portion of the electrical cord 250) in a vertical direction, or a force applied to the connector 220 (or another portion of the electrical cord 250) in a combination of a horizontal direction and vertical direction. In some implementations, the horizontal direction can be primarily a horizontal direction and/or the vertical direction can be primarily a vertical direction.

As shown in FIG. 2A, a protrusion contact 270 is disposed within (e.g., embedded within) the protrusion portion 224 of the connector 220. The protrusion contact 270 can be disposed within the protrusion portion 224 so that a surface 271 of the protrusion contact 270 is exposed to an ambient environment around the protrusion portion 224 via an opening 223 (which can be referred to as a contact opening). The opening 223 and the surface 271 of the protrusion contact 270 collectively define a recess. The surface 271 of the protrusion contact 270 can be exposed so that the surface 271 of the protrusion contact 270 can come in contact with a curved portion 232 of a receptacle contact 230 when the protrusion portion 224 of the connector 220 is disposed within the receptacle 260 as shown in FIG. 2C. As shown in FIG. 2A, the receptacle contact 230 has a cantilevered structure. In some implementations, a side of the protrusion portion 224 through which the protrusion contact 270 is exposed can be referred to as a contact side of protrusion portion 224. Although not shown in FIGS. 2A through 2D, in some implementations, the opening 223 can have a circular shape (or profile), a rectangular shape (or profile), a square shape (or profile), and/or so forth.

Figure 2B:
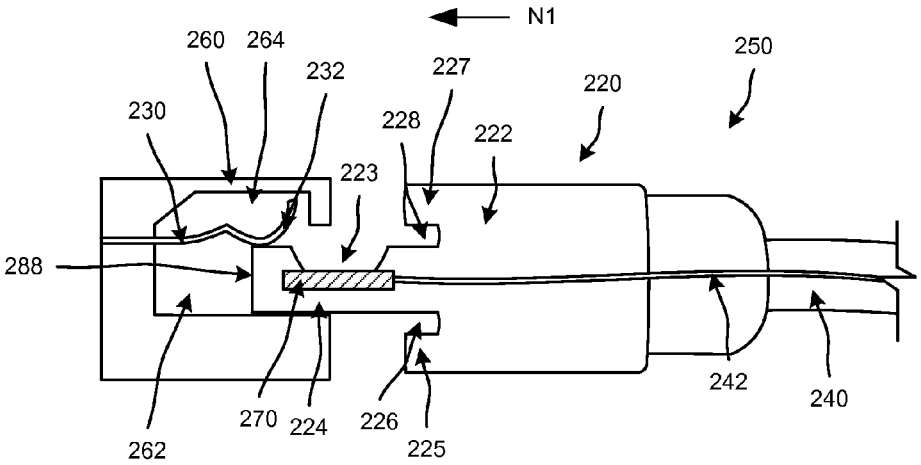
Figure 2C:
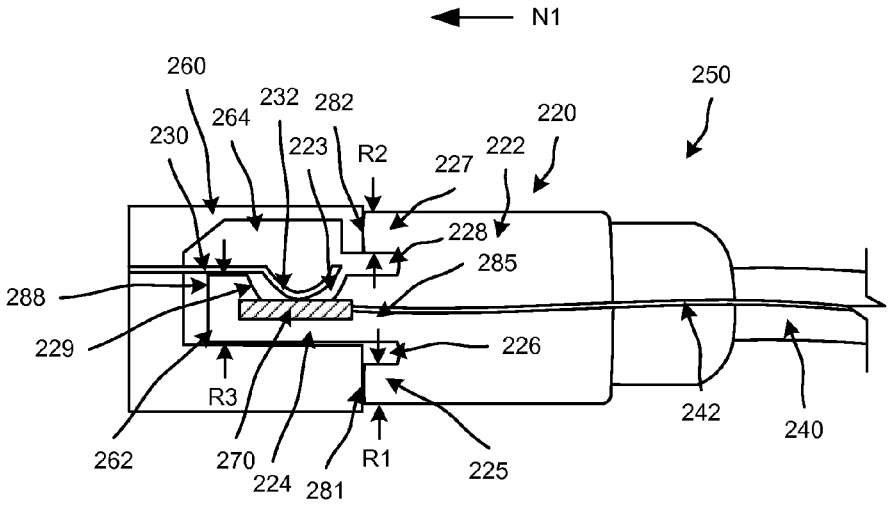

The protrusion portion 224 of the connector 220 can be moved along direction N1 into the receptacle 260 as shown in FIG. 2B. At least a portion of the protrusion portion 224 can cause the receptacle contact 230 to deflect in an upward direction (as shown in FIG. 2B) until a curved portion 232 of the receptacle contact 230 is moved into the recess and physically contacts (e.g., touches) the surface 271 of the protrusion contact 270 (as shown in FIG. 2C). As shown in FIG. 2B, the receptacle contact 230 is configured to deflect upward into a recess 264 of the receptacle 260.

In this implementation, the receptacle contact 230 is curved so that the curved portion 232 has a concave shape where the concave portion faces in an upward direction. In some implementations, the receptacle contact 230 can have a different side cross-sectional profile than that shown in FIG. 2B. For example, in some implementations, the receptacle contact 230 can have one or more curved portions, one or more angled portions with acute or obtuse angles, and/or so forth. As shown in at least FIG. 2B, the protrusion contact 270 is coupled to a wire 242 that is disposed within the electrical cord 250. In some implementations, one or more signals can be sent to or received through the wire 242 in the electrical cord 250 via conduction between the receptacle contact 230 and the protrusion contact 270.

Figure 2D:
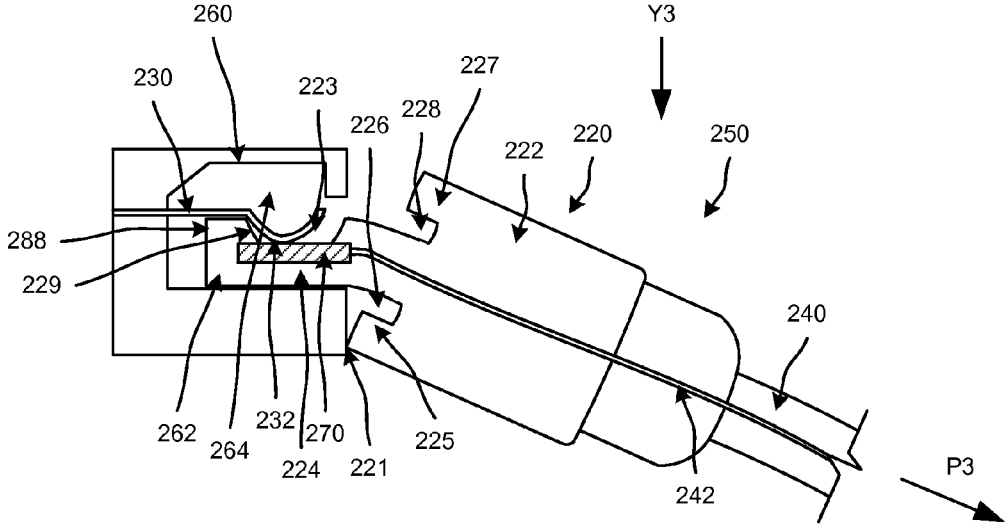

As shown in FIG. 2C, the connector 220 has a protrusion portion 227 (which can be referred to as an upper protrusion portion as oriented in FIG. 2C) disposed above the protrusion portion 224 and a protrusion portion 225 (which can be referred to as a lower protrusion portion as oriented in FIG. 2C) disposed below the protrusion portion 224. In other words, the protrusion portion 224 is disposed between the protrusion portions 225, 227. As shown in FIG. 2D, a recess 228 is disposed between the protrusion portion 224 and the protrusion portion 227, and a recess 226 is disposed between the protrusion portion 224 and the protrusion portion 225.

As shown in FIG. 2C, the protrusion portion 227 and the protrusion portion 225 are each aligned along planes that are parallel to the plane along which the protrusion portion 224 is aligned. In some implementations, the protrusion portion 227 and/or the protrusion portion 225 to be aligned along planes that are non-parallel to the plane along which the protrusion portion 224 is aligned. As shown in FIG. 2C, the protrusion portion 225, the protrusion portion 227, and the protrusion portion 224 each have a square or rectangle or profile. In some implementations, the protrusion portion 225, the protrusion portion 227, and/or the protrusion portion 224 can have a profile with a different shape such as a triangular profile, a rounded end profile. A connector having protrusion portions and recesses with different profiles are shown in, for example, FIG. 15.

As shown in FIG. 2C, the protrusion portion 224 has a portion 285 (which can be referred to as a proximal portion of the protrusion portion 224) disposed outside of the receptacle 260 when a distal surface 282 (or distal end) of the protrusion portion 227 is in contact with the receptacle 260 and/or when a distal surface 281 (or distal end) of the protrusion portion 225 is in contact with the receptacle 260. Accordingly a distal portion of the protrusion portion 224 is disposed within the receptacle 260 when the portion 285 is disposed outside of the receptacle 260. As shown in FIG. 2C, the protrusion portions 225, 227 remain disposed outside of the receptacle 260 when the protrusion portion 224 is inserted into the receptacle 260.

As shown in FIG. 2C, a length of the protrusion portion 227 and a length of the protrusion portion 225 are shorter than a length of the protrusion portion 224 (from a distal end of the protrusion portion 224 to a proximal end of the protrusion portion). In some implementations, the protrusion portion 227 and the protrusion portion 225 can have different lengths. In such implementations, the recess 228 and the recess 226 can have the same depth or can have different depths. Although not shown, in some implementations, the connector 220 can have a single recess (e.g., only recess 228 or only recess 226) and single protrusion portion (e.g., only protrusion portion 227 or only protrusion portion 225) in addition to protrusion portion 224, which can be inserted into the receptacle 260.

The curved portion 232 of the receptacle contact 230 can be configured to hold the connector 220 in a desirable position within the receptacle 260 in response to relatively small forces applied (e.g., a relatively small force applied in a direction opposite direction N1) to the connector 220. As shown in FIG. 2C, the curved portion 232 is configured to be disposed within the recess formed by the opening 223 and the protrusion contact 270. The protrusion portion 224 has a surface 229 that can contact the curved portion 232 and maintain a position of the protrusion portion 224 of the connector 220 in the receptacle 260. In some implementations, the curved portion 232 can have a profile that matches with at least a portion of a profile of the recess formed by the opening 223 and the protrusion contact 270. As will be discussed below in connection with FIG. 2D, in response to a relatively large force, the connector 220 and the receptacle 260 can be configured so that the connector 220 can be released from receptacle 260 without causing undesirable damage to, for example, the electrical cord 250 and/or the receptacle 260.

As shown in FIG. 2C, the protrusion portion 224 has a thickness R3 that is greater than a thickness R1 of the protrusion portion 225 or a thickness R2 of the protrusion portion 227. In some implementations, the thickness R3 can be less than or equal to the thickness R1 of the protrusion portion 225 and/or the thickness R2 of the protrusion portion 227. In some implementations, the thickness R1 of the protrusion portion 225 and/or the thickness R2 of the protrusion portion 227 can taper (e.g., taper with decreasing thickness away from the support portion 222 or taper with decreasing thickness toward the support portion 222).

As shown in FIG. 2C, the thickness R3 of the protrusion portion 224 on a distal side of the opening 223 is equal to the thickness R3 of the protrusion portion 224 on a proximal side of the opening 223. Although not shown in FIG. 2C, in some implementations, the protrusion portion 224 can have a thickness on the distal side of the opening 223 can be greater than or less than a thickness of the protrusion portion 224 on a proximal side of the opening 223.

FIG. 2D is a side cross-sectional view of the connector 220 and the receptacle 260 when a force is applied along direction Y3 to the connector 220 (and/or the wire component 240). As shown in FIG. 2D, the connector 220 has an edge 221 (or point) around which the connector 220 pivots when a force is applied along direction Y3. As the connector 220 pivots about the edge 221, the connector 220 and the wire component 240 are moved along direction P3 until the connector 220 is moved out of (e.g., entirely out of) the receptacle 260. In some implementations, the edge 221 can function as a fulcrum. In some implementations, the connector 220 can be referred to as rotating about an axis when the force applied along direction Y3. In some implementations, the axis can be at, or approximately at, the edge 221. Although not shown, the connector 220 can similarly be decoupled from the receptacle 260 in response to a force applied along a direction opposite direction Y3. At least a portion of the protrusion portion 225 and/or the protrusion portion 227 can function as a fulcrum in a horizontal direction and/or can function has a fulcrum in a vertical direction.

As shown in FIG. 2D, the protrusion portion 224 is configured to bend (or flex) in response to the force being applied along direction Y3. Specifically, in this implementation, at least a portion of the portion 285 is configured to bend in response to the force being applied. In this implementation, the bending of the protrusion portion 224 facilitates (e.g., permits) removal of the connector 220 from the receptacle 260. As shown in FIG. 2D, the surface 229 of the protrusion portion 224 can contact the curved portion 232 and maintain a position of the protrusion portion 224 of the connector 220 in the receptacle 260 until the protrusion portion 224 is removed from the receptacle 260 in response to the force. In some implementations, the connector 220 can be configured with the recesses 226, 228 so that the protrusion portion 224 has the portion 285 that can bend in response to the force being applied. Without the recesses 226, 228, the protrusion portion 224 would have a shorter length for flexing than with the recesses 226, 228.

Although not shown in FIG. 2D, in some implementations, the receptacle contact 230 can bend (or flex) in response to the force of the protrusion portion 224 applied to the receptacle contact 230 as the connector 220 rotates when the force is applied along direction Y3. The bending of the receptacle contact 230 can facilitate (e.g., permit) removal of the connector 220 from the receptacle 260. In some implementations, the receptacle contact 230 can be a leaf-spring type contact, a pogo pin contact, a spring-loaded ball contact, and/or so forth. An example of a spring-loaded ball contact is illustrated in, for example, FIG. 14.

Although not shown in FIGS. 2A through 2D, a connector can be configured with protrusion contacts (and corresponding receptacle contacts) on a variety of sides. For example, a connector can be configured to be coupled to a receptacle contact on more than one side (e.g., 2 adjacent sides (with a common edge), 2 non-adjacent sides (without a common edge), 3 sides, 4 sides, 5 sides). In some implementations, a contact (not shown) can be coupled to an end surface 288 at a distal end portion of the protrusion portion 224. In such implementations, a corresponding contact (not shown) can be included in the receptacle 260.

Figure 3B:
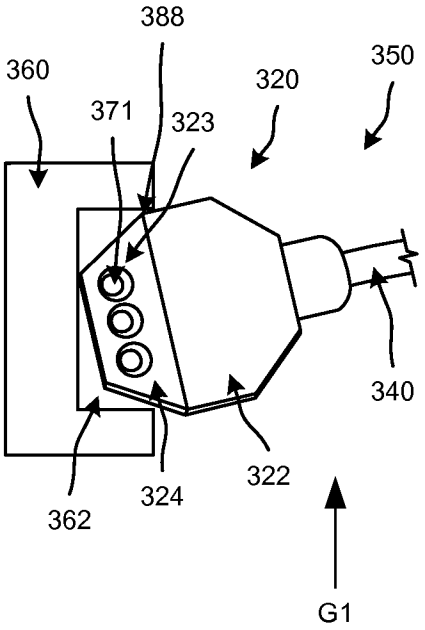
FIG. 3B illustrates a cross-sectional view of the components shown in FIG. 3A when a force is applied along a direction.
Figure 3A:
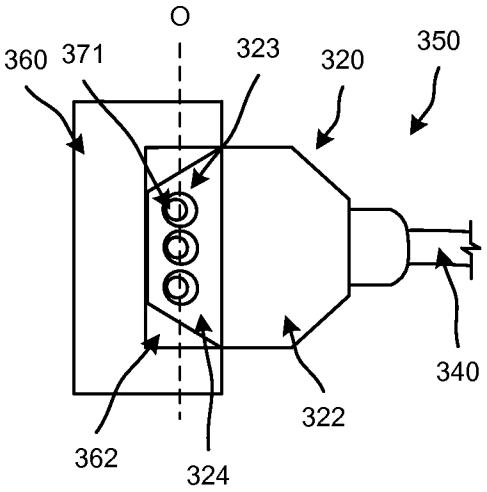
FIG. 3A illustrates a top view of a connector within a cross-section of a receptacle.

FIG. 3A illustrates a top view of a connector 320 within a cross-section of a receptacle 360. As shown in FIG. 3A, a protrusion portion 324 is disposed in a cavity 362 of the receptacle 360. In this implementation, a receptacle contact is not shown because the receptacle contact can be disposed above this cross-sectional view. As shown in FIG. 3A, the protrusion portion 324 has a trapezoidal shape (or profile) that extends from a support portion 322. Accordingly, in this implementation, the protrusion portion 324 has a shape that tapers or has chamfers. In some implementations, the protrusion portion 324 can have a shape on a distal end that has a radius or curve.

As shown in FIGS. 3A and 3B, the protrusion portion 324 includes an opening 323 (which can be referred to as a contact opening) through which a surface 371 of a protrusion contact is exposed. In this implementation, the protrusion portion 324 has three contact openings through which three contacts are exposed. In some implementations, a protrusion portion 324 can have more than three contact openings (and more than three protrusion contacts) or can have less than three contact openings (and less than three protrusion contacts). In some implementations, a protrusion contact can be exposed through multiple contact openings or multiple protrusion contacts can be exposed through a single contact opening.

As shown in FIG. 3A, the surface 371 of the protrusion contact and corresponding opening 323 are aligned with other protrusion contacts and openings along line O. Accordingly, when the protrusion portion 324 is moved into the receptacle 360, the protrusion contacts (including the surface 371 of protrusion contact) may come in contact with receptacle contacts at approximately the same time. In some implementations, the surface 371 of the protrusion contact and corresponding opening 323 may not be aligned with other protrusion contacts and openings along line O.

FIG. 3B illustrates a cross-sectional view of the components shown in FIG. 3A when a force is applied along direction G1 to the connector 320 (and/or the wire component 340). As shown in FIG. 3B, the connector 320 has an edge 388 (or point) around which the connector 320 pivots when a force is applied along direction G1. As the connector 320 pivots about the edge 388, the connector 320 and the wire component 340 are moved until the connector 320 is moved out of (e.g., entirely out of) the receptacle 360. In some implementations, the edge 388 can function as a fulcrum (e.g., as a horizontal fulcrum). In some implementations, the connector 320 can be referred to as rotating about an axis when the force applied along direction G1. In some implementations, the vertical axis can be at, or approximately at, the edge 388. Although not shown, the connector 320 can similarly be decoupled from the receptacle 360 in response to a force applied along a direction opposite direction G1.

Figure 4:
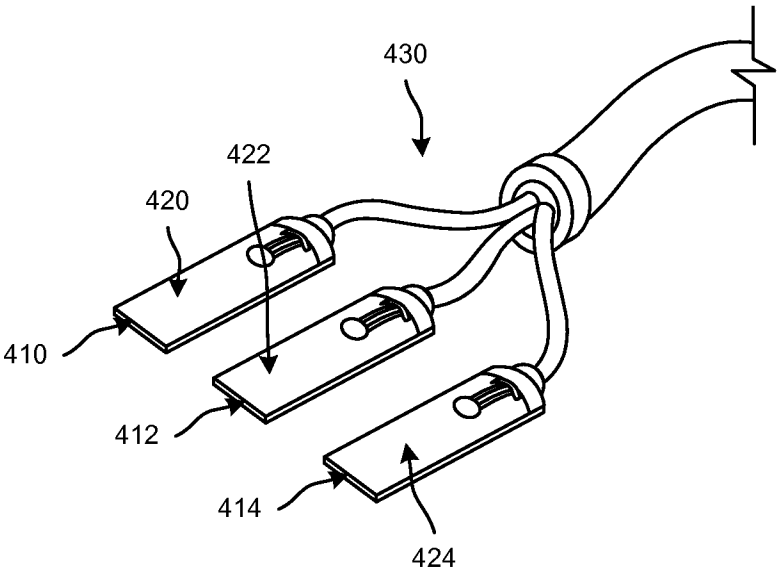
FIG. 4 is a diagram of protrusion contacts that can be disposed within a connector of an electrical cord.

FIG. 4 is a diagram of protrusion contacts 410, 412, and 414 that can be disposed within a connector of an electrical cord. In this implementation, the protrusion contacts 410, 412, and 414 have respective surfaces 420, 422, and 424 that can be exposed through openings of one or more protrusion portions of a connector. As shown in FIG. 4, wires are coupled to each of the protrusion contacts 410, 412, and 414. In some implementations, one or more of the protrusion contacts 410, 412, and 414 can correspond with power, ground, etc. from a power adaptor or signaling wire.

Figure 5:
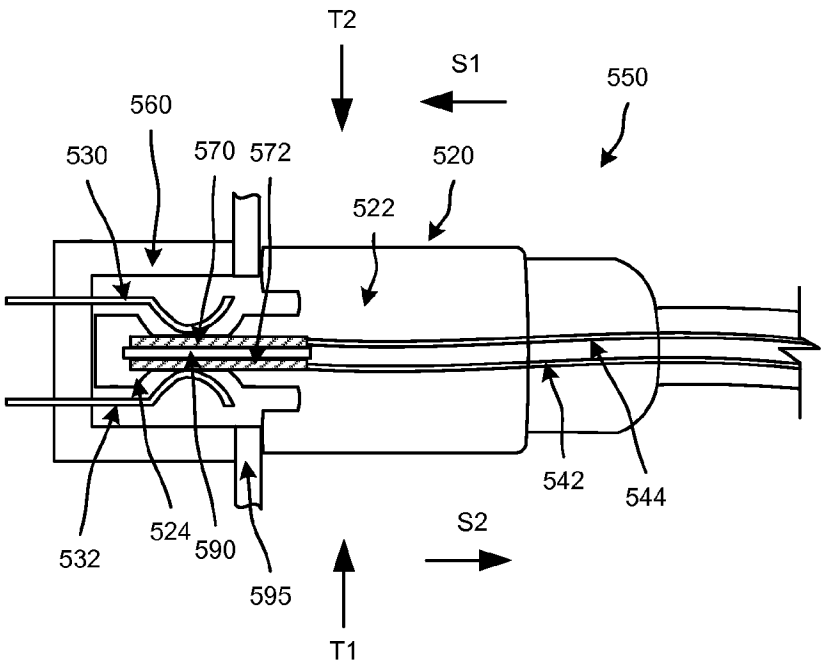
FIG. 5 illustrates a side cross-sectional view of a connector and a receptacle.

FIG. 5 illustrates a side cross-sectional view of a connector 520 and a receptacle 560. As shown in FIG. 5, the connector 520 has a support portion 522 and a protrusion portion 524. The protrusion portion 524 is configured to be inserted into (e.g., and disposed within) a cavity 562 of the receptacle 560. Although not shown, the receptacle 560 can be included in (e.g., disposed within) a housing of a computing device. In FIG. 5, the connector 520 is disposed outside of the cavity 562 of the receptacle 560. The connector 520 and the wire component 540 are included in an electrical cord 550.

As shown in FIG. 5, the receptacle 560 can be disposed within a housing 595. Accordingly, at least a portion of the housing 595 can be disposed between the receptacle 560 and the connector 520 when the protrusion portion 524 of the connector 520 is disposed in the receptacle 560. The connector 520 can be pivotally moved against the housing 595 when being released from the receptacle. Although not shown in some of the other embodiments, the receptacles shown above can be included in a housing.

The connector 520 and the receptacle 560 are configured so that the connector 520 can be readily released from (e.g., decoupled from) the receptacle 560 in response to a force applied to the connector 520 (or another portion of the electrical cord 550) along, for example, direction T1 and direction T2.

As shown in FIG. 5, protrusion contacts 570, 572 (e.g., a first or upper protrusion contact, a second or lower protrusion contact) are disposed within (e.g., embedded within) the protrusion portion 524 of the connector 520. The protrusion contacts 570, 572 can be disposed within the protrusion portion 524 so that surfaces of the protrusion contacts 570, 572 are exposed to an ambient environment around the protrusion portion 524 via openings (e.g., a first or upper opening, a second or lower opening). A surface of the protrusion contact 570 can be exposed so that the surface of the protrusion contact 570 can come in contact with a curved portion of a receptacle contact 530 when the protrusion portion 524 of the connector 520 is disposed within the receptacle 560. Also, a surface of the protrusion contact 572 can be exposed so that the surface of the protrusion contact 572 can come in contact with a curved portion of a receptacle contact 532 when the protrusion portion 524 of the connector 520 is disposed within the receptacle 560. As shown in FIG. 5, the protrusion portion 524 has two contact sides (which are opposite one another) through which the protrusion contacts 570, 572 are exposed. Although not shown in FIG. 5, in some implementations, the openings through which the protrusion contacts 570, 572 are exposed can have a circular shape (or profile), a rectangular shape (or profile), a square shape (or profile), and/or so forth.

As shown in FIG. 5, the protrusion contacts 570, 572 are separated by at least an insulating component 590. As shown in FIG. 5, the protrusion contact 570 is coupled to a wire 544, and the protrusion contact 572 is coupled to a wire 542. In some implementations, one or more signals can be sent to or received through the wires 542, 544 in the electrical cord 550 via conduction between the receptacle contacts 530, 532 and the protrusion contacts 570, 572.

In some implementations, the connector 520 can be configured so that the connector 520 can be moved into the receptacle 560 in an orientation (e.g., a flipped orientation) different than that shown in FIG. 5. For example, in some implementations, the connector 520 can be configured so that the protrusion contact 570 can be in contact with the receptacle contact 532 rather than the receptacle contact 530. Similarly, the connector 520 can be configured so that the protrusion contact 572 can be in contact with the receptacle contact 530 rather than the receptacle contact 532.

The protrusion portion 524 of the connector 520 can be moved along direction 51 into the receptacle 560. At least a portion of the protrusion portion 524 can cause the receptacle contacts 530, 532 to deflect in a direction away from the protrusion portion 524 until the receptacle contacts 530, 532 physically contact (e.g., touch) the surfaces of the protrusion contacts 570, 572. As shown in FIG. 5, the connector 520 has additional protrusion portions similar to those shown in FIGS. 2A through 2D. Also, the connector 520 can have dimensions similar to those described in connection with FIGS. 2A through 2D.

Although not shown in FIG. 5, the protrusion portion 524 can be configured to bend (or flex) in response to the force being applied along, for example, directions T1 and/or T2. In this implementation, the bending of the protrusion portion 524 can facilitate (e.g., permit) removal of the connector 520 from the receptacle 560. Also, in some implementations, one or more of the receptacle contacts 530, 532 can be configured to bend (or flex) in response to the force of the protrusion portion 524 applied to the receptacle contact 530 as the connector 520 rotates when the force is applied along directions T1 and/or T2. The bending of one or more of the receptacle contacts 530, 532 can facilitate (e.g., permit) removal of the connector 520 from the receptacle 560.

Figure 6:
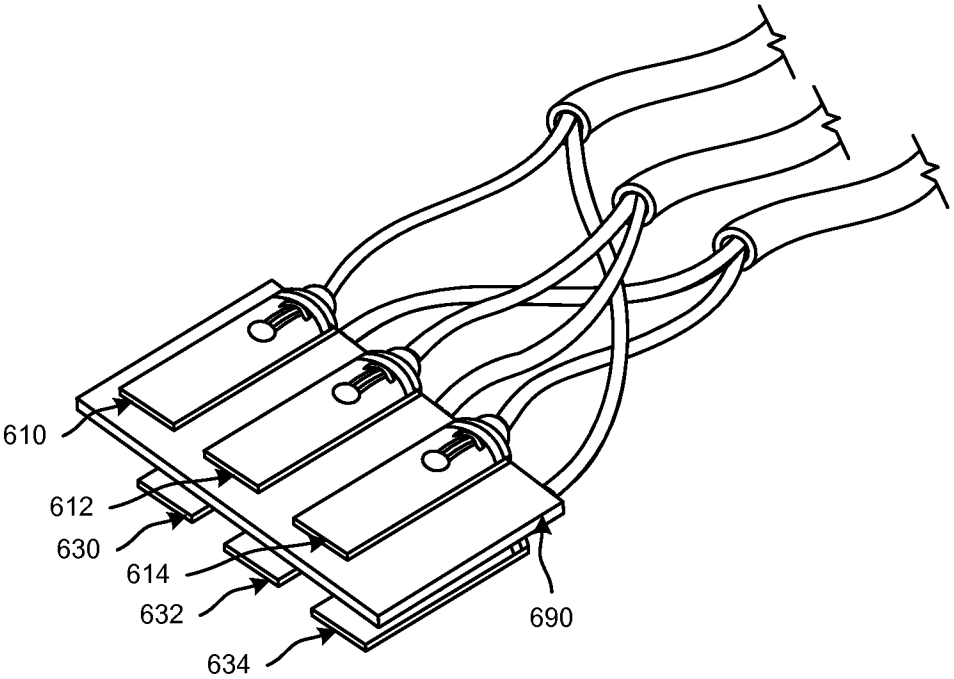
FIG. 6 is a diagram of multiple sets of contacts that can be disposed within a connector of an electrical cord.

FIG. 6 is a diagram of multiple sets of protrusion contacts that can be disposed within a connector of an electrical cord such as that shown in FIG. 5. Specifically, FIG. 6 is a diagram of a first set of protrusion contacts 610, 612, and 614 and a second set of protrusion contacts 630, 632, and 634 that can be disposed within a connector of an electrical cord (not shown). In this implementation, the first set of protrusion contacts 610, 612, and 614 and the second set of protrusion contacts 630, 632, and 634 that can be exposed through openings of one or more protrusion portions of a connector. As shown in FIG. 6, the first set of protrusion contacts 610, 612, and 614 and the second set of protrusion contacts 630, 632, and 634 are separated by (e.g., electrically insulated by) an insulating component 690. As shown in FIG. 6, wires are coupled to each of the first set of protrusion contacts 610, 612, and 614 and each of the second set of protrusion contacts 630, 632, and 634. In some implementations, one or more of the protrusion contacts 610, 612, 614, 630, 632, and 634 can correspond with power, ground, etc. from a power adaptor or signaling wire.

Figure 7:
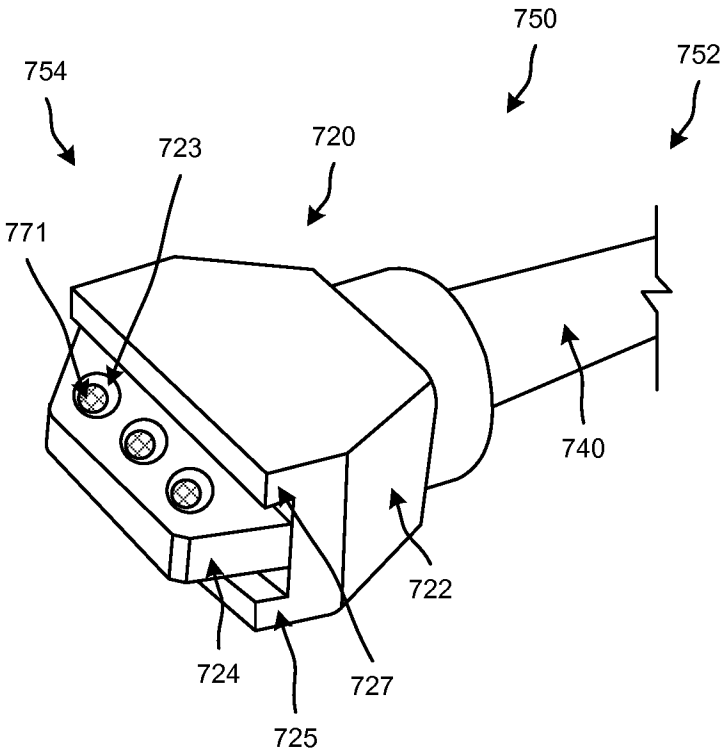
FIG. 7 illustrates a perspective view of a connector.

FIG. 7 illustrates a perspective view of a connector 720. As shown in FIG. 7, the connector 720 has a support portion 722 and a protrusion portion 724. The protrusion portion 724 is configured to be inserted into (e.g., and disposed within) a cavity of a receptacle (not shown). The connector 720 and the wire component 740 are included in an electrical cord 750.

The connector 720 is configured so that the connector 720 can be readily released from (e.g., decoupled from) the receptacle in response to a force applied to the connector 720 (or another portion of the electrical cord 750). As shown in FIG. 7, protrusion contact surface 771 is exposed to an ambient environment around the protrusion portion 724 via an opening 723 (which can be referred to as contact opening). The opening 723 and the protrusion contact surface 771 collectively define a recess that can contact a receptacle contact (not shown) when the protrusion portion 724 of the connector 720 is disposed within the receptacle. As shown in FIG. 7, the protrusion portion 724 has sloped sidewalls. In other words, the protrusion portion 724 tapers from a proximal end portion 752 of the electrical cord 750 toward a distal end portion 754 of the electrical cord 750.

As shown in FIG. 7, the connector 720 has a protrusion portion 727 (which can be referred to as an upper protrusion portion as oriented in FIG. 7) disposed above the protrusion portion 724 and has a protrusion portion 725 (which can be referred to as a lower protrusion portion as oriented in FIG. 7) disposed below the protrusion portion 724. In other words, the protrusion portion 724 is disposed between the protrusion portions 725, 727. In some implementations, one or more of the protrusion portions 725, 727 may or may not taper from the proximal end portion 752 of the electrical cord 750 to the distal end portion 754 of the electrical cord 750. In some implementations, one or more of the protrusion portions 725, 727 may or may not taper from the distal end portion 754 of the electrical cord 750 to the proximal end portion 752 of the electrical cord 750. At least a portion of the protrusion portion 725 and/or the protrusion portion 727 can function as a fulcrum (or pivot point) when the connector 720 is rotated in a horizontal direction and/or can function has a fulcrum (or pivot point) when the connector 720 is rotated in a vertical direction.

Figure 8:
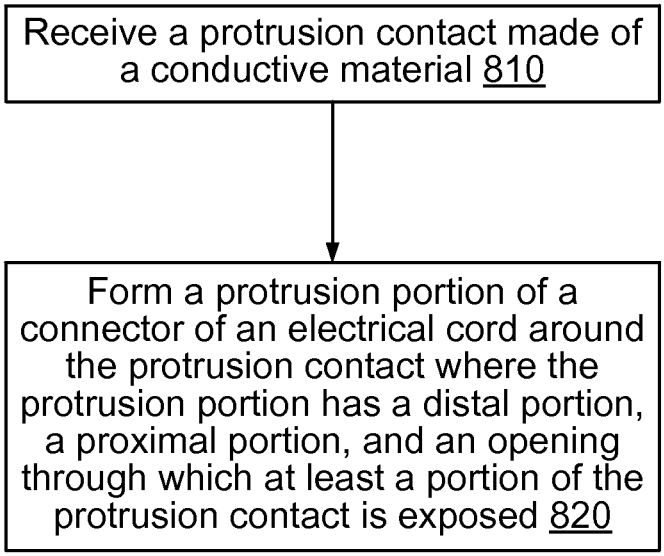
FIG. 8 is a diagram that illustrates a method for making a connector of an electrical cord, according to an implementation.

FIG. 8 is a diagram that illustrates a method for making a connector of an electrical cord, according to an implementation. The connector can be any of the connectors described in herein such as, for example, connector 120 shown in FIGS. 1A through 1E.

As shown in FIG. 8, a protrusion contact made of a conductive material is received (block 810). In some implementations, the protrusion contact can be formed from a conductive material such as a metal. In some implementations, the protrusion contact can be coupled to a wire. In some implementations, the protrusion contact can have a flat structure and can be insulated from another protrusion contact.

A protrusion portion of a connector of an electrical cord is formed around the protrusion contact where the protrusion portion has a distal portion, a proximal portion, and an opening through which at least a portion of the protrusion contact is exposed (block 820). The protrusion portion can have a width tapering from the proximal portion to the distal portion. In some implementations, the protrusion portion can be made of a relatively flexible material such as an elastomer.

In some implementations, the protrusion portion can be coupled to a support portion of the connector. In some implementations, at least a portion of a wire component can be coupled to a first side of the support portion, and the proximal portion of the protrusion portion can be coupled to a second side of the support portion. In some implementations, the support portion of the connector can be monolithically formed with the protrusion portion (and/or additional protrusion portions). Accordingly, the support portion can be referred to as having the protrusion portion. In some implementations, the support portion can have multiple protrusion portions that can be formed on the same side of the support portion. In some implementations, multiple protrusion contacts can be embedded within the protrusion portion.

Figure 9:
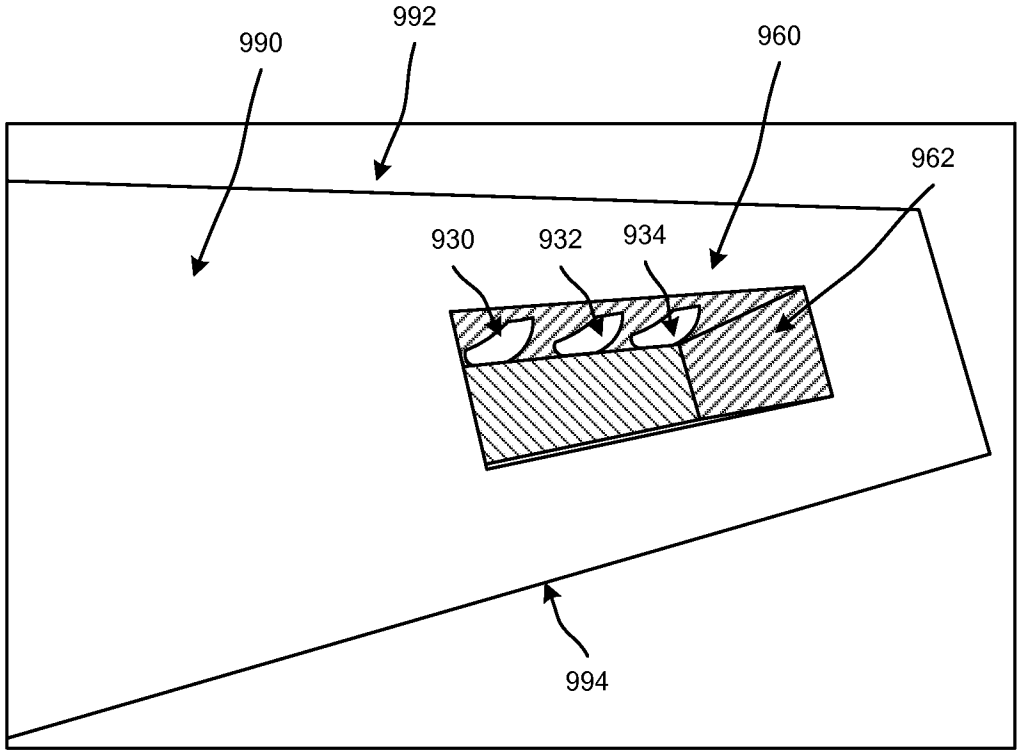
FIG. 9 is a diagram that illustrates at least a portion of a receptacle included in a housing of a computing device, according to an implementation.

FIG. 9 is a diagram that illustrates at least a portion of a receptacle 960 included in a housing 990 of a computing device, according to an implementation. As shown in FIG. 9, the receptacle 960 includes a cavity 962 into which a connector (not shown) can be inserted (e.g., plugged). Also as shown in FIG. 9, receptacle contacts 930, 932, and 934 are exposed within the cavity 962. The receptacle contacts 930, 932, and 934 can be configured to contact one or more protrusion contacts included in (e.g., embedded within) a connector. As shown in FIG. 9, the receptacle contacts 930, 932, 934 are aligned along a horizontal plane (not shown) along which a top surface 992 and/or a bottom surface 994 of the housing 990 of the computing device is also aligned.

Figure 10A:
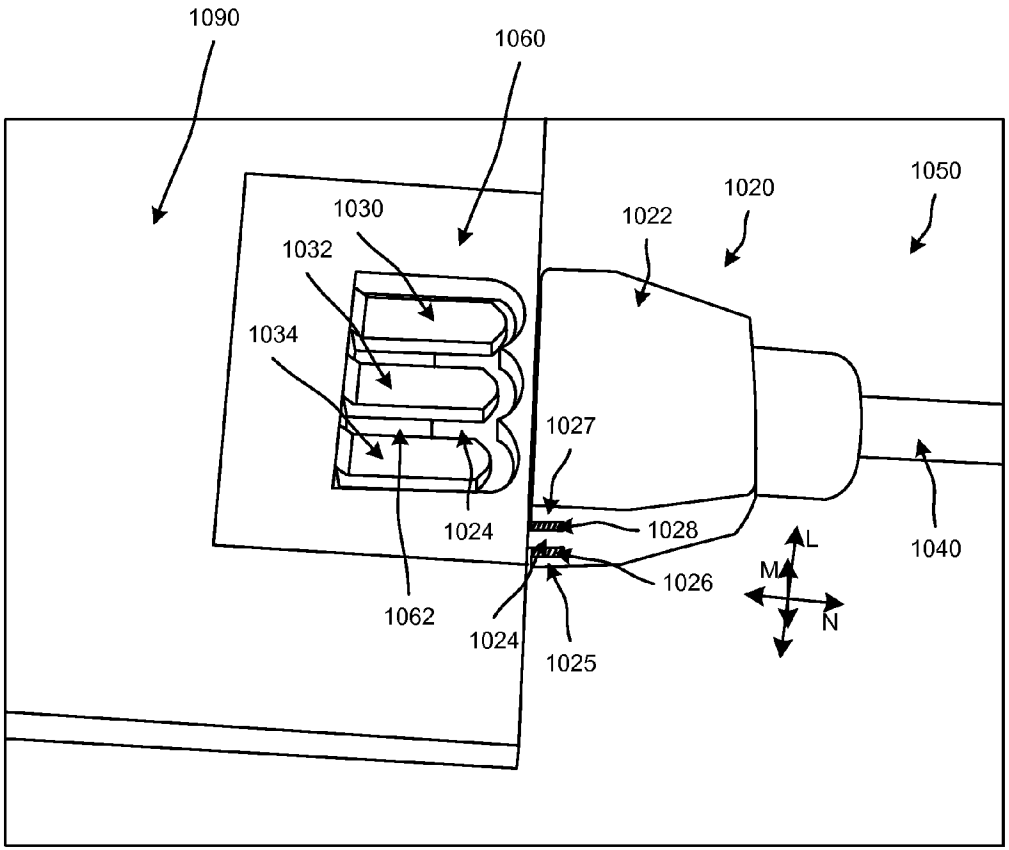
FIG. 10A illustrates a perspective view of a connector and a cross-section of a receptacle.

FIG. 10A illustrates a perspective view of a connector 1020 and a cross-section of a receptacle 1060. As shown in FIG. 10A, the connector 1020 has a support portion 1022 and a protrusion portion 1024. The protrusion portion 1024 is configured to be inserted into (e.g., and disposed within) a cavity 1062 of a receptacle 1060. The receptacle 1060 can be included in (e.g., disposed within) a housing 1090 of a computing device. The connector 1020 and a wire component 1040 are included in an electrical cord 1050.

The connector 1020 and the receptacle 1060 are configured so that the connector 1020 can be readily released from (e.g., decoupled from) the receptacle 1060 in response to a force applied to the connector 1020 (or another portion of the electrical cord 1050) in a horizontal direction L, a force applied to the connector 1020 (or another portion of the electrical cord 1050) in a vertical direction M, or a force applied to the connector 1020 (or another portion of the electrical cord 1050) in a combination of the horizontal direction L and the vertical direction M.

As shown in FIG. 10A, the receptacle 1060 includes receptacle contacts 1030, 1032, and 1034 that are shown as leaf-spring type receptacle contacts. In other words, as shown in FIG. 10A, the receptacle contacts 1030, 1032, and 1034 each have a cantilevered structure. As shown in FIG. 10A, portions of the protrusion portion 1024 are exposed between the receptacle contacts 1030, 1032, and 1034. As shown in FIG. 10A, the connector 1020 has additional protrusion portions 1025, 1027, and recesses 1026, 1028.

Figure 10B:
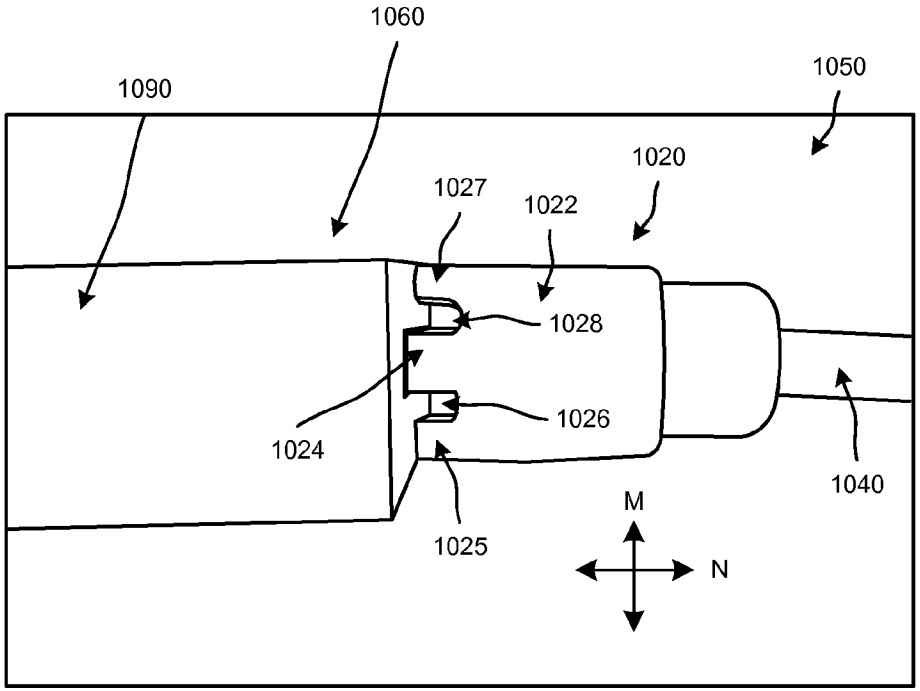
FIG. 10B illustrates a side view of the connector and the cross-section of the receptacle shown in FIG. 10A.

FIG. 10B illustrates a side view of the connector 1020 and the cross-section of the receptacle 1060 shown in FIG. 10A. As shown in FIG. 10B, the recesses 1026, 1028 extend (into and out of the page of the figure orthogonal to directions N, M) from one side of the connector 1020 to the other side of the connector 1020. In other words, the recesses 1026, 1028 extend across the width of the connector 1020 to the other side of the connector 1020.

Figure 10C:
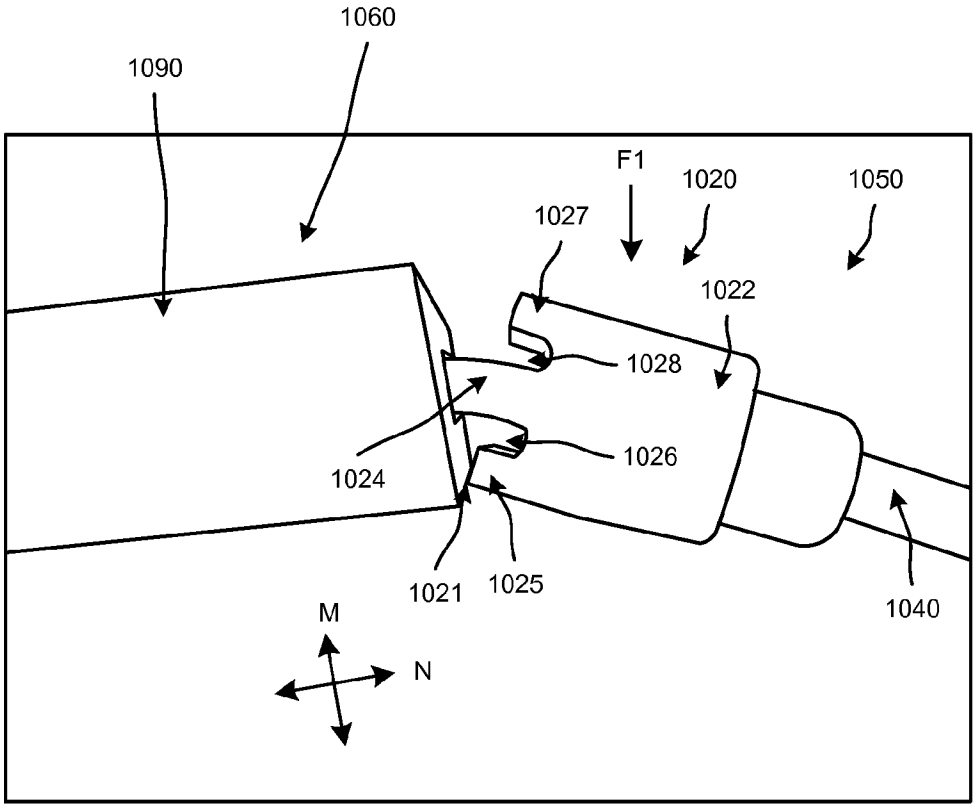
FIG. 10C is a side view of the connector and the receptacle when a force is applied along a direction to the connector.

FIG. 10C is a side view of the connector 1020 and the receptacle 1060 when a force is applied along direction F1 to the connector 1020 (and/or the wire component 1040). As shown in FIG. 10C, the connector 1020 has an edge 1021 (or point) around which the connector 1020 pivots when a force is applied along direction F1. As the connector 1020 pivots about the edge 1021, the connector 1020 and the wire component 1040 are moved until the connector 1020 is moved out of (e.g., entirely out of) the receptacle 1060. In some implementations, the edge 1021 can function as a fulcrum. As shown in FIG. 10C, the protrusion portion 1024 is configured to bend (or flex) in response to the force being applied along direction F1.

Figure 11:
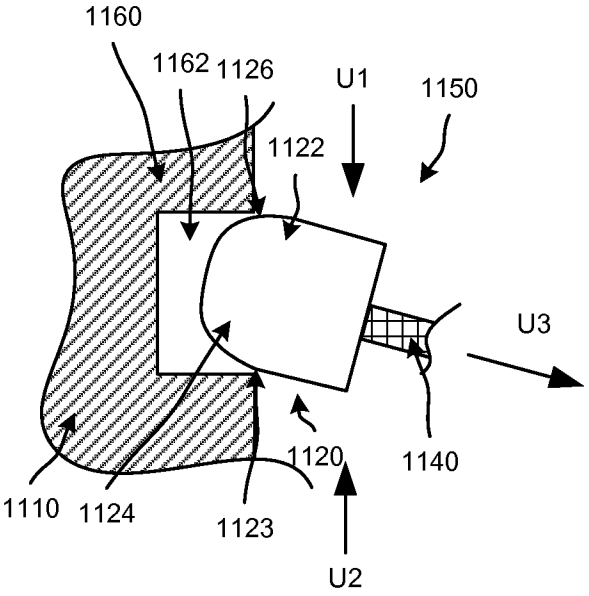
FIG. 11 is a top view of another connector.

FIG. 11 is a top view of another connector 1120. As shown in FIG. 11, the connector 1120 has a protrusion portion 1224 with a curved sidewall 1126 that curves from one side of the connector 1120 to the opposite side of the connector in a semi-circular (e.g., substantially semi-circular or curved) shape or profile. As shown in FIG. 11, the connector 1120 has an edge 1123 (or point) around which the connector 1120 pivots when a force is applied along direction U1. As the connector 1120 pivots about the edge 1123, the connector 1120 and the wire component 1140 are moved along direction U3 until the connector 1120 is moved out of (e.g., entirely out of) the receptacle 1160. In some implementations, the edge 1123 can function as a fulcrum (e.g., a fulcrum for release in a horizontal direction). Although not shown, the connector 1120 can similarly be decoupled from the receptacle 1160 in response to a force applied along direction U2.

Figure 12:
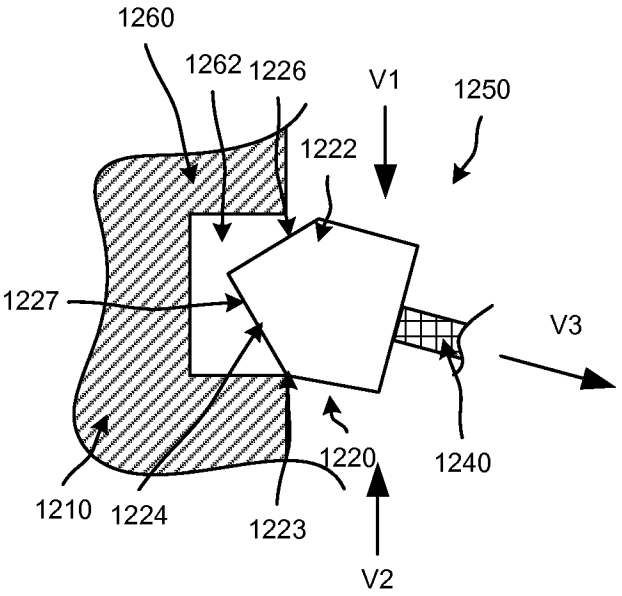
FIG. 12 is a top view of yet another connector.

FIG. 12 is a top view of yet another connector 1220. As shown in FIG. 12, the connector 1220 has a protrusion portion 1224 with a sidewall 1226 and a sidewall 1227. Accordingly, the protrusion portion 1224 has a triangular shape. As shown in FIG. 12, the connector 1220 has an edge 1223 (or point) around which the connector 1220 pivots when a force is applied along direction V1. As the connector 1220 pivots about the edge 1223, the connector 1220 and the wire component 1240 are moved along direction V3 until the connector 1220 is moved out of (e.g., entirely out of) the receptacle 1260. In some implementations, the edge 1223 can function as a fulcrum (e.g., a fulcrum for release in a horizontal direction). Although not shown, the connector 1220 can similarly be decoupled from the receptacle 1260 in response to a force applied along direction V2.

Figure 13:
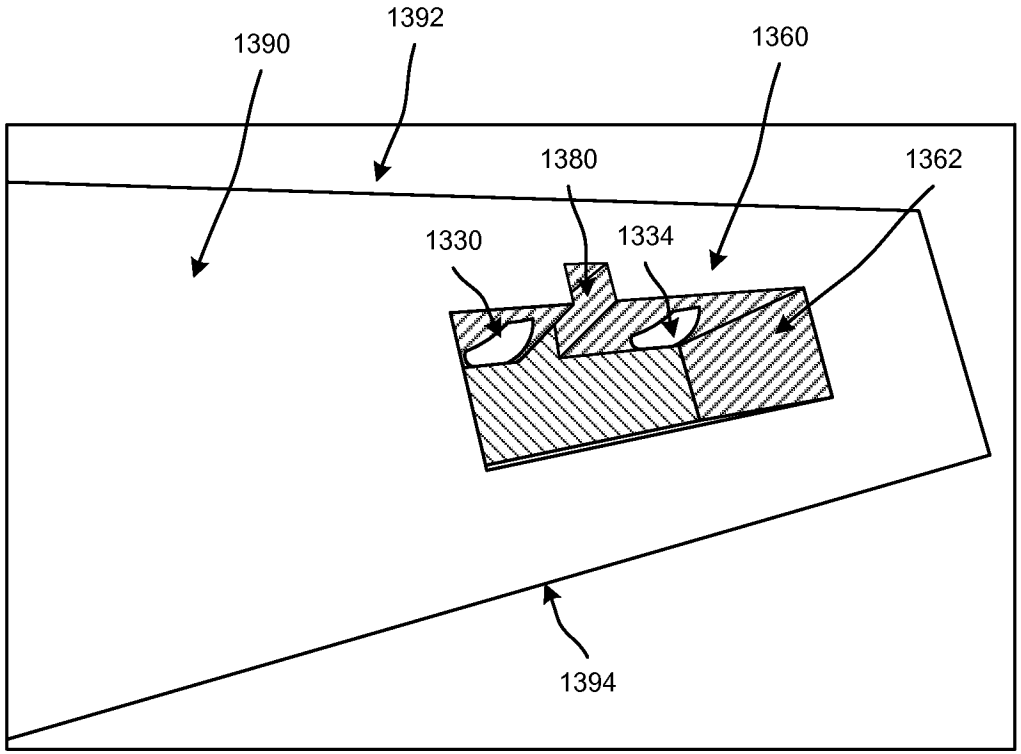
FIG. 13 is a diagram that illustrates at least a portion of a receptacle included in a housing, according to an implementation.

FIG. 13 is a diagram that illustrates at least a portion of a receptacle 1360 included in a housing 1390 of a computing device, according to an implementation. As shown in FIG. 13, the receptacle 1360 includes a cavity 1362 into which a connector (not shown) can be inserted (e.g., plugged). As shown in FIG. 13, the receptacle includes a slot 1380 (also can be referred to as a recess or notch) into which a protrusion of a connector (not shown) can be inserted. The slot 1390 and the protrusion of the connector can be configured so that the connector may be inserted into the protrusion in a pre-defined orientation. In some implementations, the slot 1390 (and corresponding protrusion of a connector) can have a different shape, orientation, and/or location than shown in FIG. 13. Also as shown in FIG. 13, receptacle contacts 1330 and 1334 are exposed within the cavity 1362. The receptacle contacts 1330 and 1334 can be configured to contact one or more protrusion contacts included in (e.g., embedded within) a connector.

Figure 14:
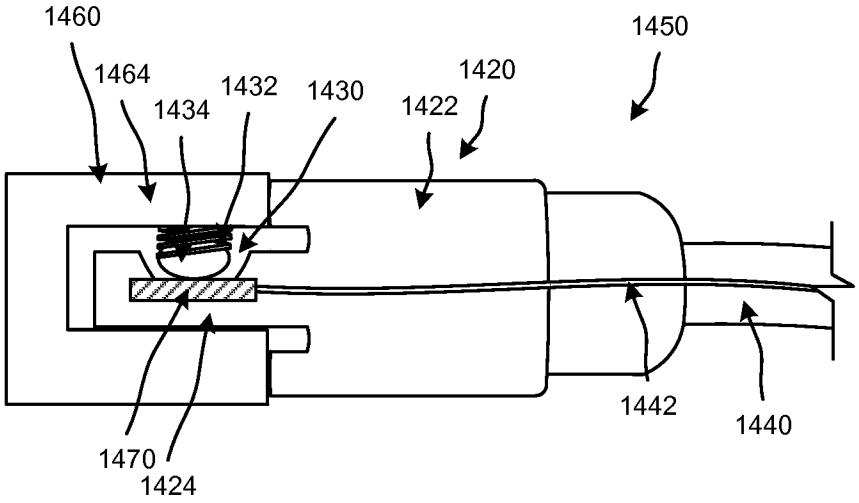
FIG. 14 illustrates a side cross-sectional view of a connector and a receptacle.

FIG. 14 illustrates a side cross-sectional view of a connector 1420 and a receptacle 1460. As shown in FIG. 14, the connector 1420 has a support portion 1422 and a protrusion portion 1424. The protrusion portion 1424 is configured to be inserted into (e.g., and disposed within) the receptacle 1460. Although not shown, the receptacle 1460 can be included in (e.g., disposed within) a housing of a computing device. In FIG. 14, the connector 1420 is disposed outside of the receptacle 1460. The connector 1420 and the wire component 1440 are included in an electrical cord 1450. As shown in FIG. 14, the receptacle 1460 includes a receptacle contact 1430 that includes a spring 1432 and a ball 1434. The receptacle contact 1430 is in contact with a protrusion contact 1470.

Figure 15:
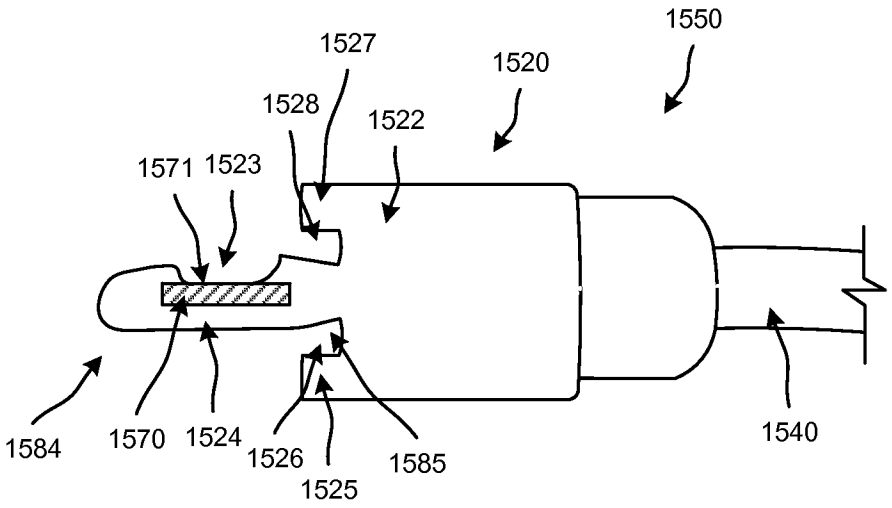
FIG. 15 illustrates a side cross-sectional view of another connector.

FIG. 15 illustrates a side cross-sectional view of another connector 1520. As shown in FIG. 15, the connector 1520 has a support portion 1522 and a protrusion portion 1524. The protrusion portion 1524 is configured to be inserted into (e.g., and disposed within) a cavity of a receptacle (not shown). The connector 1520 and the wire component 1540 are included in an electrical cord 1550. The connector 1520 can be configured so that the connector 1520 can be readily released from (e.g., decoupled from) a receptacle 1560 in response to a force applied to the connector 1520. As shown in FIG. 15, a protrusion contact 1570 is disposed within (e.g., embedded within) the protrusion portion 1524 of the connector 1520.

As shown in FIG. 15, the protrusion portion 1524 has a rounded distal end portion 1584. Also, the protrusion portion 1524 has a tapered proximal end portion 1585 (tapering in the proximal direction toward the support portion 1522). Because of the tapering of the proximal end portion 1585, recesses 1526, 1528 (which corresponding with protrusion portions 1525, 1527) increase in size in the proximal direction.

Figure 16:
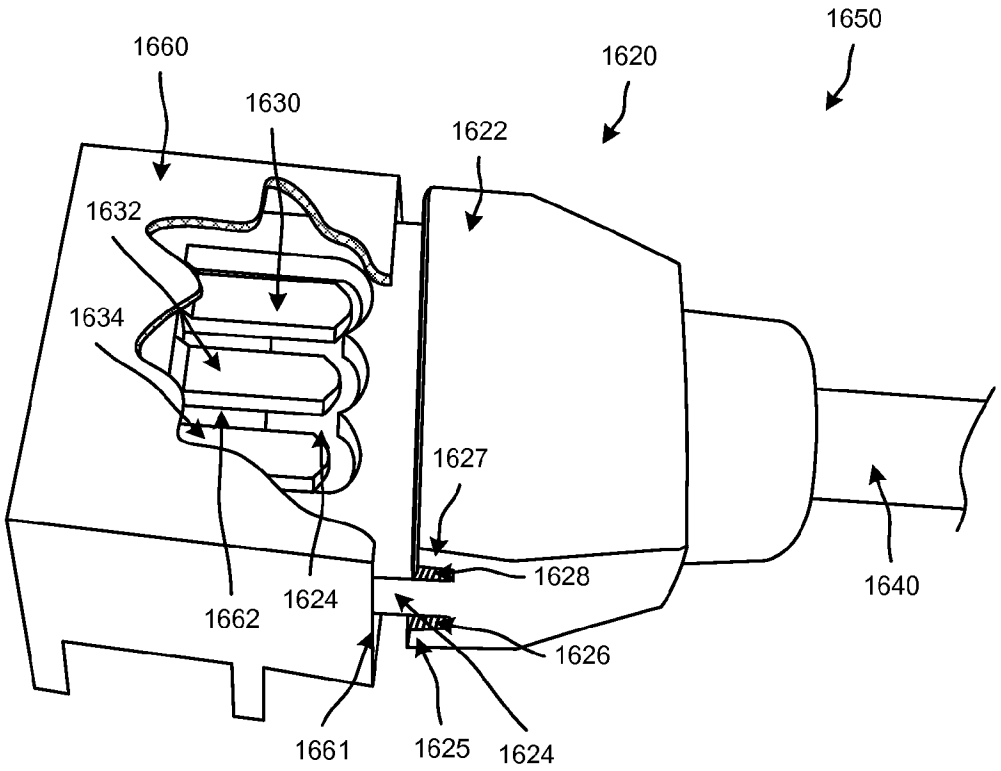
FIG. 16 illustrates a perspective view of a connector and a cross-section of a receptacle.

FIG. 16 illustrates a perspective view of a connector 1620 and a cross-section of a receptacle 1660. As shown in FIG. 16A, the connector 1620 has a support portion 1622 and a protrusion portion 1624. The protrusion portion 1624 is configured to be inserted into (e.g., and disposed within) a cavity 1662 of a receptacle 1660. The connector 1620 and a wire component 1640 are included in an electrical cord 1650.

The connector 1620 and the receptacle 1660 are configured so that the connector 1620 can be readily released from (e.g., decoupled from) the receptacle 1660 in response to a force applied to the connector 1620 (or another portion of the electrical cord 1650) in a horizontal direction, a force applied to the connector 1620 (or another portion of the electrical cord 1650) in a vertical direction, or a force applied to the connector 1620 (or another portion of the electrical cord 1650) in a combination of the horizontal direction and the vertical direction.

As shown in FIG. 16, the receptacle 1660 includes receptacle contacts 1630, 1632, and 1634 that are shown as leaf-spring type receptacle contacts. As shown in FIG. 16, portions of the protrusion portion 1624 are exposed between the receptacle contacts 1630, 1632, and 1634. As shown in FIG. 16, the connector 1620 has additional protrusion portions 1625, 1627, and recesses 1626, 1628.

Although not shown in FIG. 16, the receptacle 1660 can be included in (e.g., disposed within) a housing (not shown) of a computing device. At least a portion of the housing can be disposed between the distal ends of one or more of the protrusion portions 1625, 1627 and the proximal end 1661 of the receptacle 1660.

Implementations of the various techniques described herein may be implemented in digital electronic circuitry, or in computer hardware, firmware, software, or in combinations of them. Implementations may implemented as a computer program product, i.e., a computer program tangibly embodied in an information carrier, e.g., in a machine-readable storage device (computer-readable medium, a non-transitory computer-readable storage medium, a tangible computer-readable storage medium) or in a propagated signal, for processing by, or to control the operation of, data processing apparatus, e.g., a programmable processor, a computer, or multiple computers. A computer program, such as the computer program(s) described above, can be written in any form of programming language, including compiled or interpreted languages, and can be deployed in any form, including as a stand-alone program or as a module, component, subroutine, or other unit suitable for use in a computing environment. A computer program can be deployed to be processed on one computer or on multiple computers at one site or distributed across multiple sites and interconnected by a communication network.

Method steps may be performed by one or more programmable processors executing a computer program to perform functions by operating on input data and generating output. Method steps also may be performed by, and an apparatus may be implemented as, special purpose logic circuitry, e.g., an FPGA (field programmable gate array) or an ASIC (application-specific integrated circuit).

Processors suitable for the processing of a computer program include, by way of example, both general and special purpose microprocessors, and any one or more processors of any kind of digital computer. Generally, a processor will receive instructions and data from a read-only memory or a random access memory or both. Elements of a computer may include at least one processor for executing instructions and one or more memory devices for storing instructions and data. Generally, a computer also may include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory may be supplemented by, or incorporated in special purpose logic circuitry.

To provide for interaction with a user, implementations may be implemented on a computer having a display device, e.g., a cathode ray tube (CRT) or liquid crystal display (LCD) monitor, for displaying information to the user and a keyboard and a pointing device, e.g., a mouse or a trackball, by which the user ca provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Implementations may be implemented in a computing system that includes a back-end component, e.g., as a data server, or that includes a middleware component, e.g., an application server, or that includes a front-end component, e.g., a client computer having a graphical user interface or a Web browser through which a user can interact with an implementation, or any combination of such back-end, middleware, or front-end components. Components may be interconnected by any form or medium of digital data communication, e.g., a communication network. Examples of communication networks include a local area network (LAN) and a wide area network (WAN), e.g., the Internet.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

What is claimed is:

1. An apparatus, comprising:

a support portion of a connector;

a wire component coupled to a first side of the support portion;

a protrusion portion having a distal portion, a proximal portion, and an opening disposed between the distal portion and the proximal portion, the proximal portion coupled to a second side of the support portion, the protrusion portion having a width tapering from the proximal portion to the distal portion, the proximal portion being disposed between the wire component and the opening; and a contact disposed in the protrusion portion and having a surface exposed to an ambient environment through the opening.

2. The apparatus of claim 1, wherein the width is between a first side of the protrusion portion and a second side of the protrusion portion, the width of the protrusion portion tapering to define at least one sloped wall of a trapezoidal shape.

3. The apparatus of claim 1, wherein a thickness of the protrusion portion is less than the width at the distal portion or at the proximal portion, the thickness of the protrusion portion is less than a length of the protrusion portion between a distal end of the distal portion and a proximal end of the proximal portion.

4. The apparatus of claim 1, wherein the protrusion portion is a first protrusion portion, the apparatus further comprising:

a second protrusion portion coupled to the support portion, the second protrusion portion being aligned along a plane parallel to a plane along which the first protrusion portion is aligned.

5. The apparatus of claim 1, wherein the protrusion portion is a first protrusion portion, the apparatus further comprising:

a second protrusion portion coupled to the support portion such that a recess is formed between the second protrusion portion and the first protrusion portion.

6. The apparatus of claim 1, wherein the protrusion is a first protrusion, the apparatus further comprising:

a second protrusion portion having a length greater than a length of the first protrusion portion.

7. The apparatus of claim 1, wherein the protrusion portion is made of a flexible material.

8. The apparatus of claim 1, wherein the opening is formed in a first contact side of the protrusion portion, the protrusion portion has a second contact side opposite the first contact side and aligned parallel to the first contact side.

9. The apparatus of claim 1, wherein the protrusion portion is aligned along a longitudinal axis intersecting the support portion, the support portion has a first edge configured to function as a first fulcrum when the support portion is rotatably moved about a first axis orthogonal to the longitudinal axis, and has a second edge configured to function as a second fulcrum when the support portion is rotatably moved about a second axis orthogonal to the longitudinal axis and orthogonal to the first axis.

10. An apparatus, comprising:

a support portion;

a wire component coupled to a first side of the support portion;

a protrusion portion extending from a second side of the support portion and aligned along a longitudinal axis intersecting the support portion, the protrusion portion having a length along the longitudinal axis greater than a width between a first side and a second side of the protrusion portion, the first side of the protrusion portion being aligned along a line non-parallel to the longitudinal axis, the protrusion portion having an opening disposed between the first side and the second side; and a contact disposed in the protrusion portion and having a surface exposed to an ambient environment through the opening.

11. The apparatus of claim 10, wherein the opening is a circular opening.

12. The apparatus of claim 10, wherein the line is a first line, the second side of the protrusion portion is aligned along a second line non-parallel to the longitudinal axis.

13. The apparatus of claim 10, wherein the first side has a curved surface.

14. The apparatus of claim 10, wherein the protrusion portion has a proximal end portion coupled to the support portion and extends in a distal direction from the support portion, the protrusion portion has a thickness on a distal side of the opening equal to a thickness of the protrusion portion on a proximal side of the opening.

15. The apparatus of claim 10, wherein the protrusion portion has a thickness smaller than a thickness of the support portion, the protrusion portion has a width at a proximal end of the protrusion portion equal to a width of the support portion.

16. A method, comprising:

receiving a protrusion contact including a conductive material; and forming a protrusion portion of a connector of an electrical cord around the protrusion contact, the protrusion portion having a distal portion, a proximal portion, and an opening through which at least a portion of the protrusion contact is exposed, the protrusion portion having a width tapering from the proximal portion to the distal portion, the electrical cord including a wire component, the proximal portion being disposed between the wire component and the opening.

17. The method of claim 16, wherein the protrusion portion is a first protrusion portion, the forming includes forming a support portion coupled to the proximal portion of the first protrusion portion, the support portion having a second protrusion portion on a same side of the support portion as the first protrusion portion.

18. The method of claim 16, wherein the width is between a first side of the protrusion portion and a second side of the protrusion portion, the width of the protrusion portion tapering to define at least one sloped wall of a trapezoidal shape.

19. The method of clam 16, wherein the protrusion contact is coupled to a wire.

20. The method of claim 16, wherein a thickness of the protrusion portion is less than the width at the distal portion or at the proximal portion, the thickness of the protrusion portion is less than a length of the protrusion portion between a distal end of the distal portion and a proximal end of the proximal portion.

* * * * *

UNITED STATES PATENT AND TRADEMARK OFFICE

CERTIFICATE OF CORRECTION

PATENT NO. : 9,263,818 B2
APPLICATION NO. : 13/734622
DATED : February 16, 2016
INVENTOR(S) : Lawrence Lam et al.

It is certified that error appears in the above-identified patent and that said Letters Patent is hereby corrected as shown below:

In The Claims

In column 20, line 14, in claim 19, delete “clam 16,” and insert -- claim 16, --, therefor.

Signed and Sealed this
Third Day of May, 2016

Michelle K. Lee

Michelle K. Lee
*Director of the United States Patent and Trademark Office*